US005634716A

United States Patent [19]

Westall et al.

[11] Patent Number: 5,634,716

[45] Date of Patent: Jun. 3, 1997

[54] PORTABLE BATCH BLENDING SYSTEM

[75] Inventors: Thomas L. Westall; Thomas Nowak; David R. Griffith, all of Salina; Earl L. Maltbie, Canton; Curtis L. Crandall, Olathe, all of Kans.

[73] Assignee: Coronado Engineering, Inc., Salina, Kans.

[21] Appl. No.: 550,462

[22] Filed: Oct. 30, 1995

[51] Int. Cl.[6] ..... B01F 15/04

[52] U.S. Cl. ..... 366/141; 414/332; 414/919

[58] Field of Search ..... 366/16, 18, 26, 366/141; 414/332, 919

[56] References Cited

U.S. PATENT DOCUMENTS 3,343,688 9/1967 Ross ..... 366/18

3,448,866 6/1969 Perry .

4,775,275 10/1988 Perry ..... 366/18

5,362,193 11/1994 Milstead ..... 414/332

5,411,329 5/1995 Perry ..... 366/26

*Primary Examiner*—Robert W. Jenkins

*Attorney, Agent, or Firm*—Edward L. Brown, Jr.

[57] ABSTRACT

A portable PVC resin blending system mounted in a semi-monocoque steel silo having multiple levels therein. The various components of the blending system are mounted within and attached to the silo and lifting lugs on the silo capable of lifting and tilting the silo from a vertical to a horizontal position for transportation and re-erection.

15 Claims, 3 Drawing Sheets

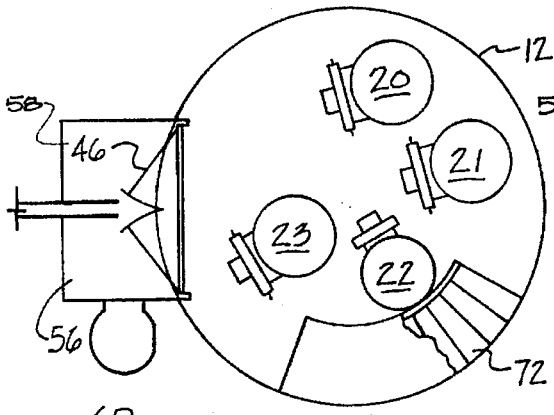
FIG 6 50' ELEV.
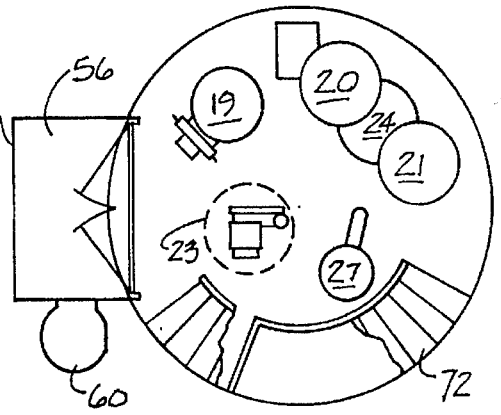
FIG 5 40' ELEV.
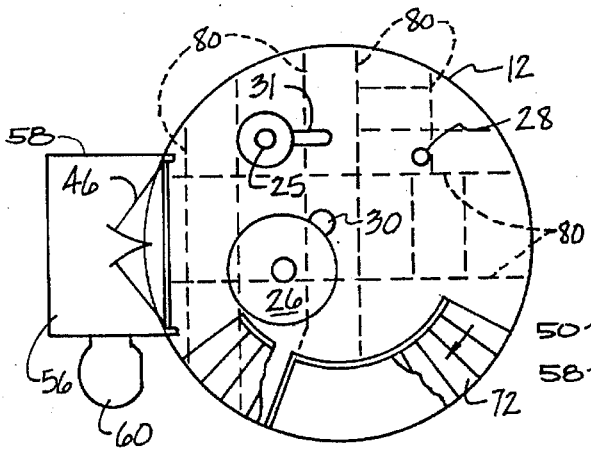
FIG 4 30' ELEV.
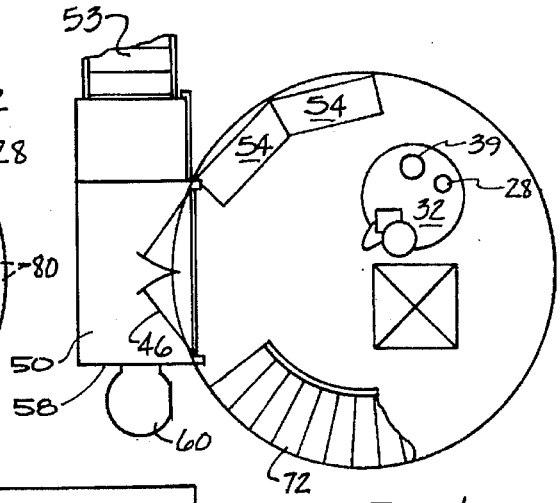
FIG 3 20' ELEV.
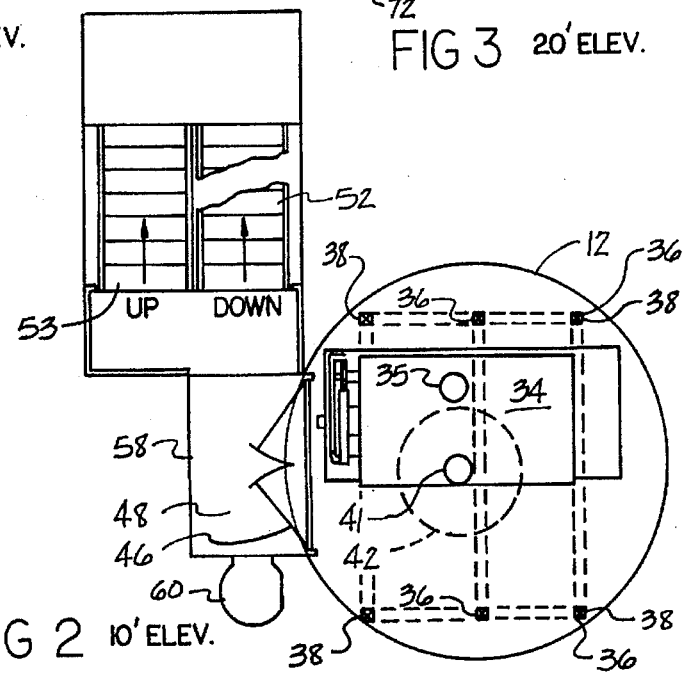
FIG 2 10' ELEV.

PORTABLE BATCH BLENDING SYSTEM

BACKGROUND OF THE INVENTION

The concept of a blending or mixing system being portable is not new. Portable concrete batch plants are common as typified by the U.S. Pat. No. 3,448,866 to Perry et al. They are transported horizontally and when the construction site is reached, they are elevated to a vertical position by a variety of methods, one of which is taught by Perry.

Also, asphalt batch plants are transported in sections by a plurality of trucks and are erected at the construction site, as shown by the U.S. Pat. No. 5,362,193 to Milstead. This batch plant as well as the one previously mentioned are supported on a structural steel I beam frame rather than a semi-monocoque steel silo, as in the present invention.

Mobile batch plants have been limited to modest size and they have been unsuitable for larger plants by reason of the massive weight and size of the tower structure.

Plastic resin blending systems such as the type of the present invention have been built in stationary I beam steel towers of relatively large size which are in turn surrounded by a building structure to insulate them from the elements. Their horizontal cross-sectional size has been in a range between 600 sq. feet and 1,200 sq. feet and up to 60 feet or more in height.

SUMMARY OF THE INVENTION

By reason of vertically positioning of the various feeding hoppers, tightly positioning the conveying tubes, airlocks and mixers, the resin blending and mixing system of the present invention has been able to reduce its horizontal cross-sectional size by approximately 75 percent to a 14-foot diameter cylinder or less. In place of the structural frame, a lightweight semi-monocoque steel silo has been substituted with multiple levels which support the various hoppers, scales, conveying tubes, valves and mixing apparatus through various floors in the silo structure.

By reducing the cross-sectional size of the blending system to a 14-foot diameter cylinder, this blender system can now be transported across roads even though silos may be up to 60 feet in length.

While the specific system illustrated is a polyvinyl chloride (PVC) resin blending system, the invention has potential use in a variety of other batch mixing and blending applications such as paints, minerals, foods, chemical and the pharmacy industry. The system is capable of collecting multiple and diverse powder like or granular materials and collating these materials in precisely measured batches that can be quickly combined and mixed at hot or ambient temperature mixtures. Pneumatic handling equipment usually transfers the blended material away from the silo mounted system to various storage bins within a factory to be used in forming products such as extruded PVC siding for houses.

All of the previous resin blending batch plants were constructed in a stationary tower surrounded by a building structure and roof. The silo-mounted systems of the present invention are relatively light and versatile in that they can be transported to the factory site in a near complete system which is lifted by cranes from a horizontal to a vertical position and can be in operation within a few days. Since the system is a portable unit, it can be readily relocated to another factory site if desired. If the blending system, such as the one illustrated in the drawing, requires a large and heavy mixer, the mixer can be separately set on a ground supported frame over which the silo and the remainder of the blending system can be lowered into place. The silo-mounted blending system provides a major advance in the economy of mixing, not only in the cost of the system but also the time of bringing the system on line. Since the entire system is pre-constructed and assembled at the factory prior to shipment, the installation time is a mere fraction of those prior art systems which required the construction of a structural steel tower and a building to surround it prior to the installation of the various components of the blending system within that structure.

Therefore, the principal object of the present invention is to provide a reduced cost, portable, preassembled blending system which can be readily put into place and operated.

Another object of the present invention is to provide a portable batch blending; system contained within a structural steel silo which occupies a mere fraction of the space of the prior art resin blending systems.

A further object of the present invention is to provide a portable blending system which can readily be relocated without disassembling the system in a minimal amount of time.

A further object of the present invention is to provide a resin blending system which is self-regulating since the equipment that controls the system can be located within the silo along with its operator.

Other objects and advantages that will become apparent from the following description.

BRIEF DESCRIPTION OF THE DRAWINGS

FIG. 2 is a lateral sectional view taken along line 2—2, FIG. 1;

FIG. 3 is a lateral sectional view taken along lines 3—3 at the 20-foot level in the silo;

FIG. 4 is a lateral sectional view taken along lines 4—4 at the 30-foot level;

FIG. 5 is a lateral sectional view taken along lines 5—5 at the 40-foot level; and FIG. 6 is a lateral sectional view taken along lines 6—6 at the 50-foot level;

DETAILED DESCRIPTION

Figure 1:
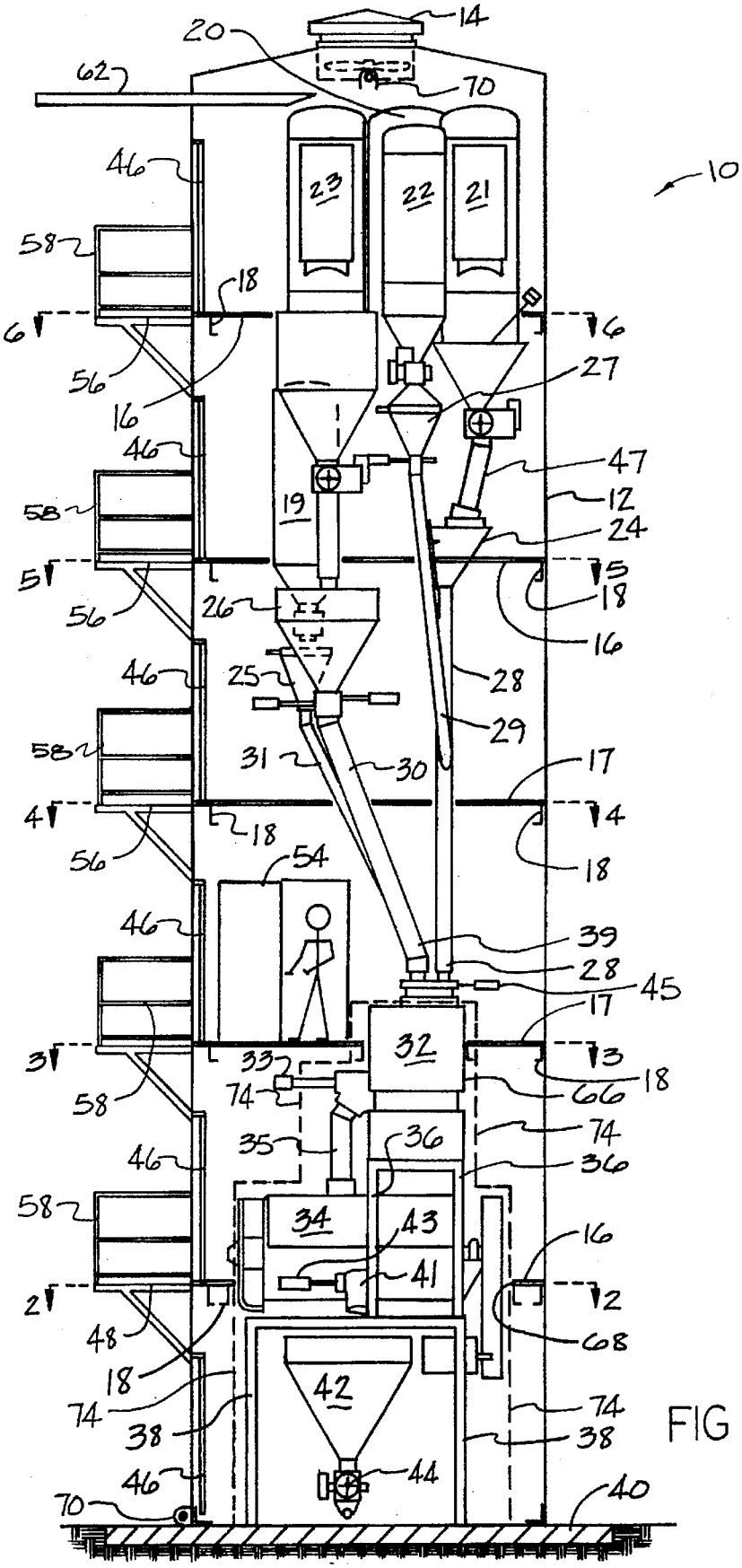
FIG. 1 is a longitudinal sectional view of the silo with the various components of the blending system symbolically shown.

The resin blending and mixing system of the present invention is generally designated by reference numeral 10 as shown in FIG. 1. The system 10 is located within a structural steel silo 12 which in turn is set and anchored on a foundation 40. The silo 12 includes five levels above the ground with open grate floors 16 at three of the five levels. Each floor 16 is supported by a channel-shaped ring 18 welded to the circumference of the silo. At each level of the silo there is an access door 46 and on the levels above the ground are balconies 48, 50 and 56, each of which is surrounded by a safety railing 58. Connecting all of the balconies to the ground is an escape ladder 60 shown in FIGS. 2–6. Located on the top of the silo is an exhaust ventilator and fan 14 which pulls air up through the floors above the 30-foot level.

The particular blending system 10 illustrated is a PVC system which blends resin, titanium dioxide($TiO_2$); calcium carbonate ($CaCO_3$) and a blend of minors which can include ingredients such as impact modifiers, process aids, calcium sterate and wax. Other blending systems, of course, could include less or more components of different substances to be compounded, such as feed mixes for animals and paint pigmentation powder. The size of other blending systems can vary with silo diameters as small as 10 feet.

Located at the top of the silo 12 are the combination vacuum receivers, hopper and airlocks 20, 21, 22 and 23. Receivers 20 and 21 both receive $TiO_2$ while receiver 23 is for resin and receiver 22 is for minors or micro ingredients. While each receiver is identified by a single reference number, it includes not only the vacuum receiver but also a hopper and airlock which are symbolically shown. If the, material being handled is difficult to convey, such as $TiO_2$, various means known in the art such as fluidized hoppers, vibrators or air hammers are used to keep the material flowing in the system.

All of these elements along with the scale hopper and gate valve below the scale hopper are standard components utilized for transporting and weighing powder and granular materials in pneumatic systems. All of the granular materials are supplied to these vacuum receivers through a standard pneumatic system, not shown in the drawing, which is piped in from the ground level into the vacuum receivers. Vacuum receiver 19 which dispenses calcium carbonate is positioned below the other three vacuum receivers at the 40-foot level. The airlocks of each of the four above-mentioned receivers meter the ingredients from each receiver through a duct into scale hopper and gate assemblies 24, 25, 26 and 27. The two $TiO_2$ receivers 20 and 21 both dump into scale hopper 24 while the minors are dumped into scale hopper 27 while the resin is metered into scale hopper 26 and the calcium carbonate is metered into scale hopper 25. Once the scales are satisfied, the above airlock ceases metering material and the particular batch of material is dropped into the heat mixer 32 when the gate valves on the scale hoppers 24, 25, 26, and 27 are opened. The $TiO_2$ flowing in tube 28 is joined with the flow of minor ingredients in tube 29 which together flow into the heat mixer 32. The resin exiting scale hopper 26 in tube 30 joins with the calcium carbonate in tube 31 into a single tube 39 which gravity flows into heat mixer 32. After the heat mixer 32 completes its mixing cycle with isolation gate 45 closed, a valve 33 is opened and the batch flows through tube 35 into the cool mixer 34. Upon completion of the cool mixer cycle a valve 43 is opened and the batch passes through tube 41 into holding hopper 42 at the bottom of the silo. Through a pneumatic line not shown in the drawing, the mixed batch is transmitted through an airlock 44 through a pneumatic line into a storage tank, not shown, located somewhere adjacent. While the basic ingredients of the blending system 10 are conveyed to the vacuum receivers in the top of the silo through a vacuum system, they also can be manually loaded into the receiver hoppers if desired or through the use of a positive pressure pneumatic system.

The heaviest parts of the blending equipment are the mixers 32 and 34 which in this example are both mounted on structural frames 36 and 38, respectively, as shown in FIGS. 1 and 2, which in turn rests on the foundation pad 40 rather than being supported by the silo 12 as are all of the other components and tubing of the blending system.

At the 10 foot and 20 foot level of the silo, the floors 16 and 17 include openings 68 and 66 respectively for passage of the mixers 34 and 32 which are mounted on their respective frames 38 and 36. The silo 12 is lowered by crane down over the previously mounted mixers 32 and 34. Also on the 20 foot level is the control panel 54 which operates and controls the entire operation of the blending system. The floors 17 at the 20 and 30-foot level can be solid rather than open lo grating as in the other levels so as to restrict the heated or cooling air flow in the lower levels. While not shown in FIG. 1, there is an interior stair 72 which extends upwardly from the 20-foot level to its top as can be seen in FIGS. 3 through 6. From the 10-foot level upward each level includes a balcony 48, 50 and 56. Between the ground and the 20-foot level there is an exterior stairs 52 and 53, as illustrated in FIGS. 2 and 3, providing exterior access by the operator to the 20-foot level where the system is controlled. Each level of the silo includes a double door 46 for access to the equipment on that level. Located on the top of the silo is a hoist beam 62 which allows the removal and replacement of equipment from any of the levels.

Figure 7:
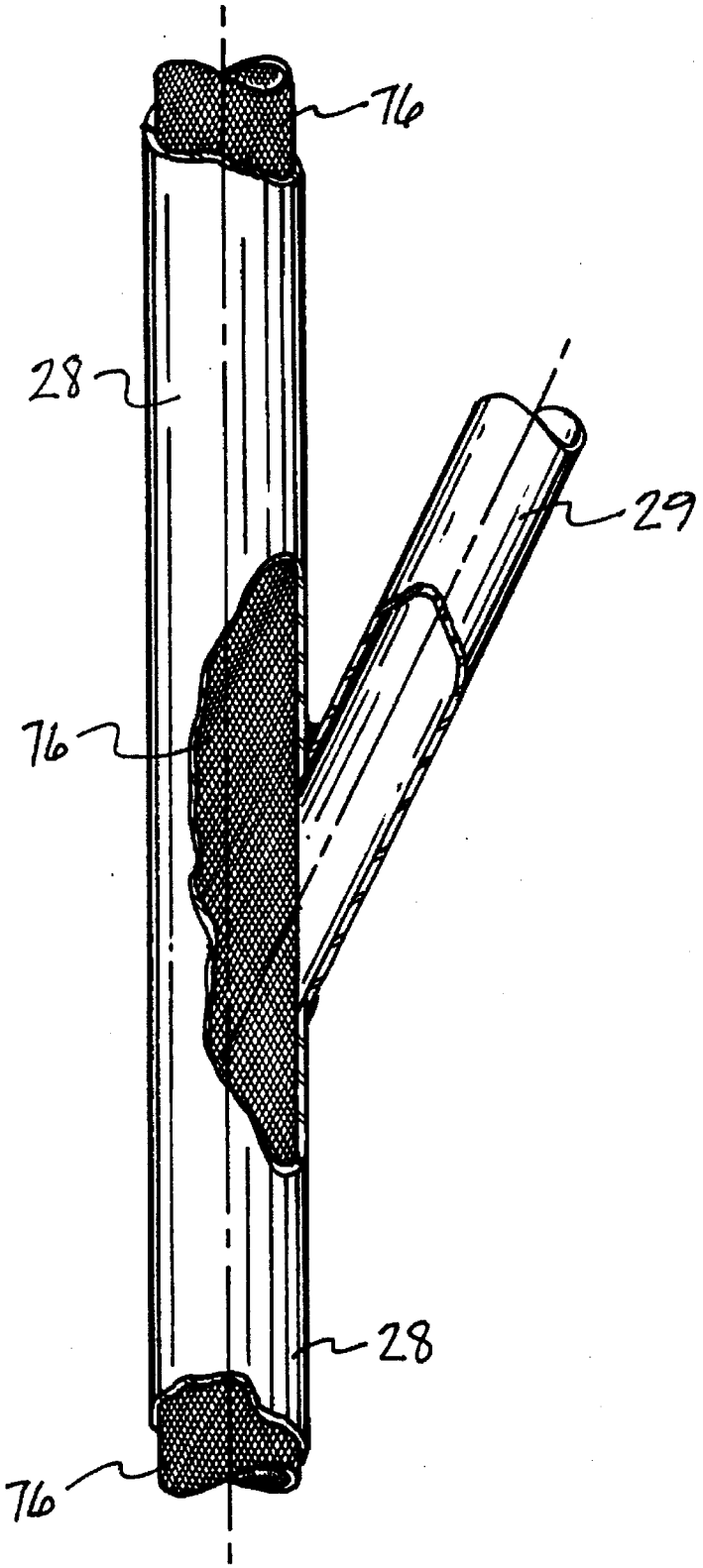
FIG. 7 is a fragmentary elevational view to an enlarged scale of the juncture two sections of tubing with portions broken away to illustrate the fabric sleeve contained therein.

In FIG. 1, the dotted line 74 defines that portion of the blending system which is ground supported and separately assembled from the remaining parts of the system which are mounted in the silo 12. As previously described, the floors of the silo at the 10-foot and 20-foot levels have openings 66 and 68 therein for passage of the combined structures of the mixers and their support frames as the silo 12 is carefully lowered by crane over the mixers. FIG. 7 illustrates in detail the $TiO_2$ tube 28 which is joined by the minor ingredients tube 29 as also can be seen in FIG. 1. Since $TiO_2$ is a difficult material to handle, the tube 28 is lined with a nylon pack cloth sleeve 76 which is attached at its upper end of tube 28 where it connects with the scale hopper 24. The bottom end of sleeve 76 which extends to the end of tube 28 is free and unattached so as to allow the minor material in tube 29 which joins with tube 28 to deflect the sleeve to the side and allow the minor materials to pass down the tube 28 on the outside of sleeve 76 into the mixer 32. Certain difficult to convey materials such as $TiO_2$ have a tendency not to attach to the pack cloth sleeve 76. The fabric sleeve technique is also used in sloping tube 47.

Supporting the open grate floors 16 on the 30, 40 and 50-foot levels are beam members 80 in various patterns as typified in FIG. 4 in dotted line. These connected beams are in turn connected to silo 12 through ring 18 in a semi-monocoque construction. The weight of the: various components in the blending system at the 30, 40 & 50-foot levels are carried by the last-mentioned floors to the silo 12.

Operation

The blending system 10 of the present invention is assembled at the point of manufacture with the silo 12 vertically positioned as shown in FIG. 1 and all of the various components in the blending system mounted within the silo with the exception of that equipment surrounded by dotted line 74. That equipment includes heat mixer 32, cool mixer 34 along with their respective supporting frames 36 and 38, hopper 42, airlock 44, and tubes 35 and 41. The two mixers 32 and 34, the heaviest components of the system, are separately transported by truck to the erection site of the system and placed on their respective frames 36 and 38 which in turn are supported on a foundation pad 40.

After all of the other components of the blending system are put in place in the silo and the control panel 54 is wired to all of its various components in the system, the portable blending system is ready for transport to the location of its installation. A series of lifting lugs 70 symbolically shown are located on the top and bottom areas of the silo 12 for lifting the silo and tilting it to a horizontal transport position. Prior to this lifting, all of the various components of the system are supported by temporary lateral struts for carrying the dead-weight load of the components with the silo in a horizontal position. At least two separate cranes are used to lift the silo 12 so that once lifted the bottom end is raised while the top is lowered until the silo is in a horizontal position and placed upon a transport trailer. At the erection site the lifting process is reversed and the silo is elevated to a vertical position with the bottom of the silo above the 20-foot level. With the mixers 32 and 34 in place on the foundation pad 40, the silo 12 is carefully lowered over the two mixers and aligned with prearranged anchor bolts, not shown, on the foundation pad 40. As soon as tubes 28 and 39 are connected to mixer 32, and the pneumatic lines supplying the vacuum receivers are connected, and the holding hopper 42 is connected to the factory storage bins, the blending system is ready to operate.

While the particular batch blending system 10 illustrated in the drawings is approximately 60 feet in height and 14 feet in diameter, various smaller batch blending systems can be constructed utilizing the same concepts. If at some later time it is so desired, the blending system can be readily moved to a different site since the overall system is totally portable.

Although the presently preferred embodiments of the invention have been described, it will be understood that within the purview of this invention various other types of blending or mixing systems may be made within the scope of the appended claims.

We claim:

1. A portable batch blending system for multiple dry ingredients comprising:

a structural silo having multiple levels therein with the height of the silo being at least twice its width;

structural floors attached to the silo defining the levels;

a blending system vertically mounted within and attached to the silo including conventional receivers, airlocks, scales and at least one mixer, all of which are connected by tubes for gravity transfer of ingredients through the blending system; and lifting means on the silo capable of lifting and tilting the silo from a vertical to a horizontal position for transportation and re-erection.

2. In a portable batch blending system, as set forth in claim 1, wherein at least one of the floors has an opening therein for passage of the system mixer and frame members supported on the ground for separate support of the system mixers apart from the silo wherein the lifting means lifts the silo and the remaining structure of the blending system carried by the silo with the exception of the system's mixers.

3. In a portable batch blending system, as set forth in claim 1, wherein the blending system includes a control panel with an operator station located within the silo on one of said levels.

4. In a portable batch blending system, as set forth in claim 1, wherein at least one of the blending system tubes is fitted with a loose weave fabric sleeve means having non-sticking qualities for difficult to convey material.

5. In a portable batch blending system, as set forth in claim 4, wherein the loose weave flexible sleeve is positioned in a 1st tube which joins with a 2nd tube conveying a second material, the second material passes between the 1st tube and said sleeve.

6. In a portable batch blending system, as set forth in claim 1, including exterior doors at each level of the silo and stairs connecting each level of the silo and the floors are attached to structural ring members which are in turn attached to the silo at the various levels of the silo.

7. In a portable batch blending system, as set forth in claim 1, including vertical ventilation means in the silo providing selective ventilation at different levels.

8. In a portable batch blending system, as set forth in claim 1, further including frame members supported on the ground for separate support of the system mixer apart from the silo wherein the lifting means lifts the silo and the remaining structure of the blending system carried by the silo off of the ground supported system mixer.

9. In a portable batch blending system, as set forth in claim 1, wherein the silo has a diameter of less than 15 feet.

10. In a portable batch blending system, as set forth in claim 1, including ventilation means up through the silo which includes an exhaust fan, and vent in the top of the silo and at least one vent in the lower levels of the silo.

11. In a portable batch blending system, as set forth in claim 1, wherein the blending system blends PVC resin.

12. In combination with a batch blending system of the type wherein conventional receivers, airlocks, scales and at least one mixer, all of which are connected by tubes for gravity transfer of ingredients through the blending system, the improvement which comprises:

a structural silo having multiple levels therein with the height of the silo being at least twice its width;

structural floors attached to the silo defining the levels;

the blending system vertically mounted within and attached to the silo; and lifting means capable of lifting and tilting the silo from a vertical to a horizontal position for transportation and re-erection.

13. In combination with a batch blending system as set forth in claim 12 including a ground supporting frame structure apart from the silo which supports the, mixers and at least one of the floors has an opening therein for passage of the system mixers supported on said frame structure.

14. In combination with a batch blending system, as set forth in claim 12, including frame members mounted on the ground for support, the system mixer and openings in the bottom of the silo and at least one of said floors for passage of the system mixer when the silo and remaining elements of the system are lifted and separated from the ground supported mixer.

15. A method of providing a portable batch blending system comprising the steps of:

mounting a conventional resin batch blending system at various levels in a structural silo;

lifting the blending system containing silo and tilting it horizontal for transportation to the erection site; and lifting the silo and its blending system to a vertical position at its place of erection.

* * * * *